US008093189B2

(12) United States Patent
Devlin et al.

(10) Patent No.: US 8,093,189 B2
(45) Date of Patent: Jan. 10, 2012

(54) LUBRICATING OIL COMPOSITIONS FOR INHIBITING COOLANT-INDUCED OIL FILTER PLUGGING

(75) Inventors: Cathy C. Devlin, Richmond, VA (US); Charles A. Passut, Midlothian, VA (US); Paul G. Griffin, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 1060 days.

(21) Appl. No.: 11/516,765

(22) Filed: Sep. 7, 2006

(65) Prior Publication Data

US 2008/0064615 A1 Mar. 13, 2008

(51) Int. Cl.
*C10M 149/00* (2006.01)
*C10M 159/12* (2006.01)

(52) U.S. Cl. ..... 508/231; 508/221; 508/287; 508/293; 508/579

(58) Field of Classification Search ..... 508/231, 508/241, 279, 287
See application file for complete search history.

(56) References Cited

U.S. PATENT DOCUMENTS

| | | | | |
|---|---|---|---|---|
| 4,863,623 | A | 9/1989 | Nalesnik | |
| 5,013,469 | A | 5/1991 | DeRosa et al. | |
| 5,094,765 | A | 3/1992 | DeRosa et al. | |
| 5,205,949 | A | 4/1993 | Nalesnik et al. | |
| 5,451,630 | A | 9/1995 | Olivier et al. | |
| 5,498,355 | A | 3/1996 | Perozzi et al. | |
| 5,719,107 | A | 2/1998 | Outten et al. | |
| 6,107,257 | A | 8/2000 | Valcho et al. | |
| 6,715,473 | B2 | 4/2004 | Ritchie et al. | |
| 6,784,142 | B2 | 8/2004 | Van Dam et al. | |
| 6,784,143 | B2 | 8/2004 | Locke et al. | |
| 6,869,919 | B2 | 3/2005 | Ritchie et al. | |
| 7,207,308 | B2 | 4/2007 | Venhaus et al. | |
| 7,253,231 | B2 | 8/2007 | Devlin et al. | |
| 7,700,684 | B2 | 4/2010 | Bradley et al. | |
| 2004/0259742 | A1 | 12/2004 | Mishra et al. | |
| 2005/0184733 | A1* | 8/2005 | Sosnowski et al. | 324/444 |
| 2006/0003905 | A1 | 1/2006 | Devlin et al. | |
| 2006/0116299 | A1* | 6/2006 | Arrowsmith et al. | 508/443 |
| 2006/0128875 | A1 | 6/2006 | Bradley et al. | |
| 2006/0173135 | A1* | 8/2006 | Devlin et al. | 525/242 |

FOREIGN PATENT DOCUMENTS

| | | | |
|---|---|---|---|
| EP | 0 338 672 | A1 | 10/1989 |
| EP | 0 922 752 | A2 | 6/1999 |
| EP | 0 922 752 | A3 | 8/2000 |
| EP | 1 669 380 | A2 | 6/2006 |
| EP | 1 686 141 | A2 | 8/2006 |
| EP | 1 686 141 | A3 | 8/2006 |
| EP | 1 669 380 | A3 | 11/2006 |
| GB | 2299087 | A | 9/1996 |
| GB | 2299088 | A | 9/1996 |
| JP | 2005-008887 | A | 1/2005 |
| JP | 2005-336486 | A | 12/2005 |
| JP | 2006-016612 | A | 1/2006 |
| JP | 2006-161042 | A | 6/2006 |
| WO | WO 2006/084698 | A2 | 8/2006 |
| WO | WO 2006/084698 | A3 | 8/2006 |
| WO | WO 2006/133848 | A1 | 12/2006 |

OTHER PUBLICATIONS

Notice of Reasons for Rejection dispatched on Nov. 30, 2010 by the Japanese Patent Office for Japanese Patent Application No. 197901/07 (4 pages) and English translation (8 pages).

R. D. Hudgens and L. B. Feldhaus, "Diesel Engine Lube Filter Life Related to Oil Chemistry," International Fuels & Lubricants Meeting, Royal York, Toronto, Nov. 13-16, 1978, Society of Automotive Engineers, Technical Paper Series (20 pages).

* cited by examiner

*Primary Examiner* — Ellen McAvoy
*Assistant Examiner* — Vishal Vasisth
(74) *Attorney, Agent, or Firm* — Leah O. Robinson; Fitch, Even, Tabin & Flannery

(57) ABSTRACT

Lubricating oil compositions are provided that inhibit coolant-induced oil filter plugging in heavy-duty diesel engines, and particularly CJ-4 and CI-4 PLUS compliant lubricating oil compositions that inhibit coolant-induced oil filter plugging in exhaust gas recirculation or recycle engines.

20 Claims, No Drawings

LUBRICATING OIL COMPOSITIONS FOR INHIBITING COOLANT-INDUCED OIL FILTER PLUGGING

FIELD OF THE INVENTION

This invention relates to lubricating oil compositions that inhibit coolant-induced oil filter plugging in heavy-duty diesel engines, and particularly CJ-4, CI-4 PLUS or CI-4 compliant lubricating oil compositions that inhibit coolant-induced oil filter plugging in exhaust gas recirculation or recycle engine systems.

BACKGROUND OF THE INVENTION

Diesel engine builders have been developing new engines with advanced emissions controls to meet greatly tightened EPA emission requirements for engines due to go into effect in the year 2007. Effective with the 2007 model year, the U.S. Environmental Protection Agency set stringent limits on nitrogen oxide (NOx) and particulate matter (PM) emissions from on-highway trucks and buses. Engines incorporating diesel oxidation catalysts and particulate filters will require significantly revised lubricant formulations than in the past.

Consequently, engine manufacturers have been developing diesel engines that not only use diesel particulate filters that trap and further reduce soot emissions but also which operate on pollution-reducing ultra-low-sulfur diesel(ULSD) fuel and utilize cooled exhaust gas recirculation (EGR) devices to redirect some of the exhaust gases normally emitted by the vehicle back into the engine, creating more internal soot.

Because the new engines operate at lower combustion and higher coolant temperatures and do not burn off the soot and other particles, and because the after treatment devices are easily damaged, existing oils, even those meeting the CI-4 or CI-4 PLUS standard, do not provide the necessary protection to meet the new emission requirements for on-highway trucks and buses.

In particular, certain performance enhancing additives used in the past will cause problems in their currently used concentrations in the new generation of diesel engines which utilize relatively sophisticated exhaust filtration systems. For instance, ash and other metallic components of the traditional additives are incombustible, and thus would remain in the system and threaten to foul the sophisticated filters that will be on the new engines, increasing maintenance costs and adding to the emissions. Therefore, low sulfur-ash-phosphorus ("low SAP") lubricant oils will be required in the industry which incorporate limits placed on certain additive components in the lubricant oil as follows: <1.0% ash, <0.12% phosphorous, and <0.4% sulfur.

The American Petroleum Institute (API) has promulgated a new lubricant category designated "CJ-4," that is specifically engineered to aid the next generation of low-emission diesel engines in meeting the 2007 engine emission standards. In order to comply with the new API CJ-4 standard, lubricant formulators and manufacturers have been facing the challenge of developing new cleaner lubricant additives and components that can deliver the combination of performance and purity that the new engines and standards demand.

For off-road use diesel engine applications, other pre-existing API oil specifications will still apply as applicable. For example, oils in the API CI-4 category are formulated for use in high-speed, four-stroke cycle diesel engines and were designed to meet the EPA exhaust emission standards that came into force in October 2002. These oils have been compounded for use in all applications with diesel fuels ranging in sulfur content up to 0.05% by weight. CI-4 PLUS, adopted in 2004, represented an enhancement to the CI-4 category. Oils meeting the CI-4 PLUS designation are formulated to meet additional soot-control requirements of specific engines with cooled EGR.

In addition to meeting ever-tightening industry standards for oil performance and purity, the present investigators also have identified a coolant system leak problem that can occur in diesel engines, such as small leaks in seals of engine coolant systems used in EGR engines, which can threaten the performance and proper operation of lubrication system. These small coolant leaks can lead to contamination of the engine lubricating oil, viz., the crankcase oil, with coolant (i.e., typically ethylene glycol, propylene glycol and/or other (poly)alkylene glycol and the like). Coolants may also contain corrosion inhibitors, and other additive agents (including bittering agents, etc.) The presence of the coolant in the lubricant system has been observed by the present investigators to induce and/or promote plugging problems in the oil filter.

Many patents have taught the manufacture and use of dispersant VII materials in engine oil formulations. These patents include, for example, U.S. Pat. Nos. 6,107,257; 5,182,041; 5,188,745; 5,238,588, 4,8636,623; 5,075,383; 6,107,258; 5,556,923; and European patents EP 0922752; EP 0909805; EP 0491456; EP 0510892; EP 0338672EP 0396297; EP0549196; and EP 0417904, all of which are incorporated herein by reference in their entirety for their teaching. None of these patents are understood to recognize and address both CJ-4, CI-4 Plus and CI-4 compliance and coolant contamination issues for diesel engine lubricating compositions.

Therefore, the present investigators have identified a need for CJ-4, CI-4 Plus and CI-4 lubricant formulations that can further multi-task to minimize or prevent oil filter plugging in heavy-duty diesel engines, such as cooled EGR engines. As will become apparent from the descriptions that follow, the invention addresses this need as well as providing other advantages and benefits.

SUMMARY OF THE INVENTION

This invention generally relates to lubricating oil compositions, particularly low SAP lubricating oils, that inhibit coolant-induced oil filter plugging in heavy-duty diesel engines. In one embodiment, the invention relates to a lubricating oil composition compliant with at least one API lubricant service category applicable to diesel emission controlled engine categories, such as CJ-4, CI-4 PLUS, CI-4, and other API categories for low emission diesel engines, that inhibits coolant-induced oil filter plugging in heavy-duty diesel engines. In another embodiment, it relates to a lubricating oil composition compliant with diesel non-emission controlled engine categories, including off road diesel engine categories such as CF-4, CG-4, CH-4, and CI-4, that inhibits coolant-induced oil filter plugging in heavy-duty diesel engines. In a particular embodiment, it relates to at least one of a CJ-4, CI-4 PLUS or CI-4 compliant lubricating oil composition that inhibits coolant-induced oil filter plugging in heavy-duty diesel engines, such as exhaust gas recirculation or recycle engine ("EGR") systems, and thereby enhance engine oil pumpability, amongst other advantages and benefits. Cooled EGR engines that are lubricated with these lubricating oil compositions are also encompassed by embodiments of the invention.

It has been surprisingly discovered that coolant-induced oil filter plugging in heavy-duty diesel engines, such as in EGR engines and the like, is inhibited by lubricating oils containing effective amounts of certain olefin copolymer ("OCP") dispersant viscosity index improvers ("OCPD VIIs") in the engine oil. The high-performance lubricating oil formulations of the present invention are versatile and can be used in engines designed and used for any of on-highway, off-road, and/or combined road uses.

For purposes herein, "inhibited" generally means to check or repress oil filter plugging, and this term is used interchangeably herein with "controlling." The "inhibition" mechanism is not particularly limited but must result in reduced occurrence in the amount of filter plugging that occurs as compared to a similar engine lubricated under similar operational conditions except with a lubricating oil composition using a non-OCPD VII in lieu of the OCPD VII additive. The level of inhibition achieved with the OCPD VII-containing lubricating oil compositions of the present invention can be total or partial. Partial inhibition will be a significant amount from a performance standpoint, e.g., the engine oil pumpability is enhanced. The term "copolymer" means and includes copolymers or terpolymers of ethylene and $C_3$ to $C_{23}$ $\alpha$-olefin, and optionally a non-conjugated diene or triene, on which has been grafted ethylenically unsaturated carboxylic reactants. For purposes herein, "low SAP" means<1.0 wt. % sulfated ash,<0.12 wt. % phosphorus, and<0.4 wt. % sulfur). In one embodiment, levels of ZDDP sources and/or detergents are reduced in the formulation to lower SAP content. Also, the term "viscosity index improver" ("VII") can be used interchangeably herein with the term "viscosity modifier" ("VM") .

In a particular embodiment, the invention relates to an API CJ-4 compliant, CI-4 PLUS or CI-4 compliant lubricating oil composition comprising a major amount of oil of lubricating viscosity and a minor amount of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging relative to a non-amine functionalized, non-acylated form of the olefin copolymer dispersant. The coolant-include filter plugging may be measured by either the Cummins ISM EGR Test, or, alternatively, a filtration test method based on ISO 13357-2 (Petroleum Products-Determination of the filterability of lubricating oils-Part 2: procedure for dry oils) using Cummins M11 HST filtration media, upon the lubricating oil composition being contaminated by about 2 percent engine coolant composed of an approximately 50:50 mixture of water and pure (poly)ethylene glycol (total), relative to a modified form of the lubricating oil composition which instead contains a non-amine functionalized, non-acylated form of the olefin copolymer dispersant but otherwise is the same.

In one embodiment in which the filtration test method based on ISO 13357-2 is applied to evaluate filter plugging, the Filtration Index (silting index data) value of the lubricating oil composition increases by no more than about 33%, particularly by no more than about 20%, upon the lubricating oil composition being contaminated by about 2 percent of said coolant, relative to the lubricating oil composition free of said coolant.

In a preferred embodiment, an API CJ-4 compliant lubricating oil composition is provided having these filter-plugging inhibition performance properties and features. At present, diesel fuel for off-road engine applications can exceed 15 ppm (until 2010), which is the suggested operable limit for CJ-4 oils without changing oil drain intervals or negatively impacting emission system performance. For lubricants used in engines operating on higher sulfur fuel levels, a CI-4 PLUS oil is preferable since it is currently recommended for both on-and off-road applications. Off-road engine applications may include, for instance, tractors, earth-moving equipment, forestry equipment, ATV's, etc.

Further, the lubricating oil compositions of the present invention are able to handle the higher operating temperatures produced by the increased percentage of exhaust gas recirculation that many engine manufacturers are using to lower NOx emissions. At the same time, the lubricating oil compositions do not increase emissions or otherwise shorten the life spans of oxidation catalysts, diesel particulate filters and other devices needed to meet the 2007 standards.

The cooled EGR engines using the lubricating oil compositions embodied herein include, for example, automotive engines, heavy and light duty diesel and gasoline truck engines, gasoline combustion engines, diesel engines, hybrid Internal Combustion/electric engines. These can include EGR engines cooled by the circulation or heat exchange of water, water/hydrocarbon blends or mixtures, water/glycol mixtures, and/or air or gas. Methods of using the lubricating compositions in such engines are also encompassed by other embodiments of the present invention.

It is to be understood that both the foregoing general description and the following detailed description are exemplary and explanatory only and are intended to provide further explanation of the present invention, as claimed.

DETAILED DESCRIPTION OF THE PREFERRED EMBODIMENTS

In one embodiment, a lubricating oil composition is presented that contains a major amount of oil of lubricating viscosity and a minor amount of an amine-functionalized olefin copolymer dispersant viscosity index improver comprising the reaction product of an acylated olefin copolymer and a polyamine compound, in which the olefin copolymer dispersant viscosity index improver is present in an amount effective to impart a property and performance capability to the oil of improved inhibition of coolant-induced filter plugging in engines lubricated with the oil, and thereby the engine oil pumpability is enhanced, oil filter replacement intervals may be prolonged, etc., amongst other advantages and benefits.

For purposes of the invention, the extent of coolant-induced filter plugging, and inhibition thereof by comparison of results for inventive oils with control or comparison oils, may be measured by either the Cummins ISM EGR Test (ASTM # pending), or, alternatively, a filtration test method based on ISO 13357-2 (Petroleum Products-Determination of the filterability of lubricating oils-Part 2: procedure for dry oils) using Cummins M11 HST filtration media, upon the lubricating oil composition being contaminated by about 2 percent engine coolant composed of an approximately 50:50 mixture of water and pure (poly)ethylene glycol (total)), relative to a modified form of the lubricating oil composition which instead contains a non-amine functionalized, non-acylated form of the olefin copolymer dispersant but otherwise is the same. In particular, API CJ-4 or API CI-4 PLUS compliant lubricating oil compositions are provided having these filter-plugging inhibition performance properties and features. However, it will be appreciated that the invention is not limited thereto. The invention generally relates to a lubricating oil composition compliant with at least one API lubricant service category applicable to diesel emission controlled engine categories, such as CJ-4, CI-4 PLUS, CI-4, and other API categories for low emission diesel engines, that inhibits coolant-induced oil filter plugging in heavy-duty diesel engines. It also more generally can relate to a lubricating oil composition compliant with diesel non-emission controlled engine categories, including off road diesel engine categories such as CF-4, CG-4, CH-4, and CI-4, that inhibits coolant-induced oil filter plugging in heavy-duty diesel engines. The lubricating oil composition also can be compliant with lubricant service categories applicable to both on road or off road diesel engines (i.e., diesel engines used in vehicles or heavy equipment operated in such environments), as well as to emission-controlled and non-emission controlled diesel engines.

The lubricating oil composition contains a filter-plugging inhibiting or controlling amount of a highly grafted, multi-functional olefin copolymer that comprises the reaction product of (1) an acylated olefin copolymer, wherein the acylated copolymer comprises copolymers or terpolymers of ethylene and $C_3$ to $C_{23}$ α-olefin and optionally a non-conjugated diene or triene on which has been grafted ethylenically unsaturated carboxylic reactants to a level of 0.15 to 1.0 carboxylic groups per 1000 number average molecular weight units (Mn), and (2) a polyamine compound selected from the group consisting of:

(a) an N-arylphenylenediamine represented by the formula:

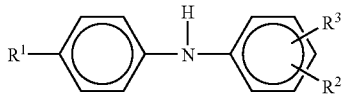

in which $R^1$ is hydrogen, —NH-aryl, —NH-arylalkyl, —NH-alkyl, or a branched or straight chain radical having from 4 to 24 carbon atoms that can be alkyl, alkenyl, alkoxyl, aralkyl, alkaryl, hydroxyalkyl or aminoalkyl; $R^2$ is —$NH_2$, $CH_2$—$(CH_2)_n$—$NH_2$, $CH_2$-aryl-$NH_2$, in which n has a value from 1 to 10 ; and $R^3$ is hydrogen, alkyl, alkenyl, alkoxyl, aralkyl, alkaryl having from 4 to 24 carbon atoms;

(b) an aminothiazole from the group consisting of aminothiazole, aminobenzothiazole, aminobenzo-thiadiazole and aminoalkylthiazole;

(c) an aminocarbazole represented by the formula:

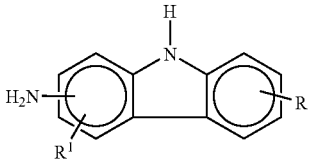

in which R and $R_1$ represent hydrogen or an alkyl, alkenyl or alkoxyl radical having from 1 to 14 carbon atoms;

(d) an aminoindole represented by the formula:

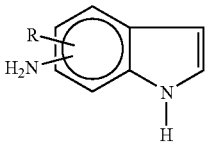

in which R represents hydrogen or an alkyl radical having from 1 to 14 carbon atoms;

(e) an aminopyrrole represented by the formula:

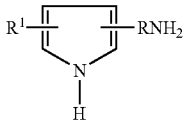

in which R is a divalent alkylene radical having 2-6 carbon atoms and $R^1$ is hydrogen or an alkyl radical having from 1 to 14 carbon atoms;

(f) an amino-indazolinone represented by the formula:

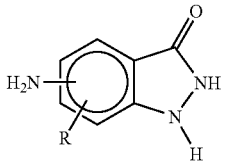

in which R is hydrogen or an alkyl radical having from 1 to 14 carbon atoms;

(g) an aminomercaptotriazole represented by the formula:

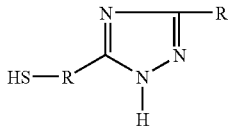

in which R can be absent or is a $C_1$-$C_{10}$ linear or branched hydrocarbon selected from the group consisting of alkyl, alkenyl, arylalkyl, or aryl;

(h) and an aminoperimidine represented by the formula:

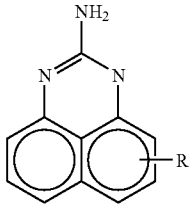

in which R represents hydrogen or an alkyl or alkoxy radical having from 1 to 14 carbon atoms;

(i) aminoalkyl imidazoles, such as 1-(2-aminoethyl) imidazole, 1-(3-aminopropyl) imidazole; and (j) aminoalkyl morpholines, such as 4-(3-aminopropyl) morpholine.

The novel lubricated cooled EGR engines described herein preferably contain lubricating compositions that comprise an oil of lubricating viscosity and a dispersant VII effective amount of the highly grafted, multi-functional olefin copolymer dispersant as described above.

In an embodiment, polymers for use herein may include copolymers of ethylene and one or more $C_3$ to $C_{23}$ alpha-olefins. Copolymers of ethylene and propylene are very effective. Other alpha-olefins suitable in place of propylene to form the copolymer or to be used in combination with ethylene and propylene to form a terpolymer include 1-butene, 1-pentene, 1-hexene, 1-octene and styrene; α,ω-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof.

More complex polymer substrates, often designated as interpolymers, may be prepared using a third component in preparing the dispersant used in the oil to lubricate cooled EGR engines. The third component generally used to prepare an interpolymer substrate is a polyene monomer selected from non-conjugated dienes and trienes. The non-conjugated diene component is one having from 5 to 14 carbon atoms in the chain. In one embodiment, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norborene, 1,5-heptadiene, and 1,6-octadiene. A mixture of more than one diene can be used in the preparation of the interpolymer. In another embodiment, a non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer of the invention are 1-isopropylidene-3α,4,7,7α-tetrahydroindene, 1-isopropylidene dicyclopentadiene, dihydro-isodicyclopentadiene, and 2-(2-methylene-4-methyl-3-pentenyl) [2.2.1] bicyclo-5-heptene.

Ethylene-propylene or higher α-olefin copolymers may consist of from about 15 to 80 mole percent ethylene and from about 85 to 20 mole percent $C_3$ to $C_{23}$ α-olefin with the mole ratios being from about 35 to 75 mole percent ethylene and from about 65 to 25 mole percent of a $C_3$ to $C_{23}$ alpha-olefin. In another embodiment, the proportions are from 50 to 70 mole percent ethylene and 50 to 30 mole percent $C_3$ to $C_{23}$ α-olefin. In yet another example, the proportions are from 55 to 65 mole percent ethylene and 45 to 35 mole percent $C_3$ to $C_{23}$ α-olefin.

Terpolymer variations of the foregoing polymers may contains from about 0.1 to 10 mole percent of a non-conjugated diene or triene.

Also useful herein as the polymer for the dispersant viscosity index improver used in an oil to lubricate a cooled EGR engine is a polymer selected from the group consisting of polymethacrylates, ethylene/propylene copolymers, polyisoprene or saturated polyisoprene, and polyisoprene/saturated polyisoprene copolymers.

The polymer substrate, that is the ethylene copolymer or terpolymer, can be an oil-soluble, linear or branched polymer having a number average molecular weight from about 5,000 to 150,000 as determined by gel permeation chromatography and universal calibration standardization, with a number average molecular weight range of 7,000 to 110,000.

The terms polymer and copolymer are used generically to encompass ethylene copolymers, terpolymers or interpolymers. These materials may contain minor amounts of other olefinic monomers so long as the basic characteristics of the ethylene copolymers are not materially changed.

The polymerization reaction used to form the ethylene-olefin copolymer substrate is generally carried out in the presence of a conventional Ziegler-Natta or metallocene catalyst system. The polymerization medium is not specific and can include solution, slurry, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffin having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

An ethylenically unsaturated carboxylic acid material is next grafted onto the prescribed polymer backbone to form an acylated ethylene copolymer. These carboxylic reactants which are suitable for grafting onto the ethylene copolymer contain at least one ethylenic bond and at least one, preferably two, carboxylic acid or its anhydride groups or a polar group which is convertible into said carboxyl groups by oxidation or hydrolysis. The carboxylic reactants are in one embodiment selected from the group consisting of acrylic, methacrylic, cinnamic, crotonic, maleic, fumaric and itaconic reactants. Alternatively, the carboxylic reactants are selected from the group consisting of maleic acid, fumaric acid, maleic anhydride, or a mixture of two or more of these. Maleic anhydride or a derivative thereof has advantages of commercial availability and ease of reaction. In the case of unsaturated ethylene copolymers or terpolymers, itaconic acid or its anhydride are useful due to its reduced tendency to form a cross-linked structure during the free-radical grafting process.

The ethylenically unsaturated carboxylic acid materials typically can provide one or two carboxylic groups per mole of reactant to the grafted polymer. That is, methyl methacrylate can provide one carboxylic group per molecule to the grafted polymer while maleic anhydride can provide two carboxylic groups per molecule to the grafted polymer.

In one embodiment, the carboxylic reactant is grafted onto the prescribed polymer backbone in an amount to provide 0.15 to 1.0 carboxylic groups per 1000 number average molecular weight units of the polymer backbone, preferably 0.3 to 0.5 carboxylic groups per 1000 number average molecular weight. For example, a copolymer substrate with Mn of 20,000 is grafted with 6 to 10 carboxylic groups per polymer chain or 3 to 5 moles of maleic anhydride per mole of polymer. A copolymer with Mn of 100,000 is grafted with 30 to 50 carboxylic groups per polymer chain or 15 to 25 moles of maleic anhydride per polymer chain. The minimum level of functionality is the level needed to achieve the minimum satisfactory dispersancy performance in lubricated cooled EGR engines.

The grafting reaction to form the acylated olefin copolymers is generally carried out with the aid of a free-radical initiator either in solution or in bulk, as in an extruder or intensive mixing device. When the polymerization is carried out in hexane solution, it is economically convenient but not required herein to carry out the grafting reaction in hexane as described in U.S. Pat. Nos. 4,340,689, 4,670,515 and 4,948,842, incorporated herein by reference. The resulting polymer intermediate is characterized by having carboxylic acid acylating functionality randomly within its structure.

The highly grafted, multi-functional olefin copolymer dispersant VIIs used to lubricate the cooled EGR engines of the present invention can be incorporated into lubricating oil in any convenient way. Thus, the highly grafted, multi-functional olefin copolymers can be added directly to the lubricating oil by dispersing or dissolving the same in the lubricating oil at the desired level of concentration. Such blending into the lubricating oil can occur at room temperature or elevated temperatures. Alternatively, the highly grafted, multi-functional olefin copolymers can be blended with a suitable oil-soluble solvent/diluent (such as benzene, xylene, toluene, lubricating base oils and petroleum distillates) to form a concentrate, and then blending the concentrate with a lubricating oil to obtain the final formulation. Such additive concentrates will typically contain (on an active ingredient (A.I.) basis) from about 3 to about 45 wt. %, and often from about 10 to about 35 wt. %, highly grafted, multi-functional olefin copolymer additive, and more often from about 40 to 60 wt. %, base oil based on the concentrate weight.

The highly grafted, multi-functional olefin copolymer products useful in lubricating oils to lubricate cooled EGR engines in accordance with embodiments of the present invention find their primary utility in lubricating oil compositions which employ base oil in which the additives are dissolved or dispersed. Such base oils may be natural, synthetic or mixtures thereof. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like.

In one embodiment, a lubricating oil composition is provided meeting the specifications of API CJ-4 oils and/or API CI-4 PLUS oils and that also inhibits the occurrence of coolant-induced filter plugging. The lubricating oil composition containing the olefin copolymer dispersant VII described above ordinarily, but not necessarily exclusively, will be added to and operated in the crankcase of a vehicle.

As indicated, the lubricating oil formulations of the present invention can be used in engines designed and used for on-highway, off-road, and/or combined road-type uses. In particular, they can be used in heavy-duty engines, especially heavy-duty diesel engines. At present, diesel fuel for off-road engine applications can exceed 15 ppm (until the year 2010), which is the suggested operable limit for CJ-4 oils without changing oil drain intervals or negatively impacting emission system performance. For lubricants used in engines operating on higher sulfur fuel levels, a CI-4 PLUS oil is preferable since it is currently recommended for both on- and off-road applications. Off-road engine applications may include, for instance, tractors, earth-moving equipment, forestry equipment, ATV's, etc.

In the preparation of lubricating oil compositions it is common practice to introduce the additives in the form of 10 to 80 wt. % active ingredient concentrates in hydrocarbon oil, e.g., mineral lubricating oil, or other suitable solvent. Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend. Thus, the highly grafted, multi-functional olefin copolymer dispersant VII may be employed in the form of a 10 to 50 wt. % concentrate, for example, in a lubricating oil fraction. Alternatively, the additives, including the OCP VII, may be directly and separately introduced into a lubricating oil formulation.

In certain embodiments herein, the olefin copolymer dispersant VII can be present in the lubricating oil composition in a cooled EGR engine in an amount of from 1 weight percent to about 18 weight percent. Active material of OCP VII may range from 0.1 to 10.0% m. As demonstrated in the working examples below, it has been noted that the use of some dispersant polymers and copolymers in lubricating oils used in cooled EGR engines can not inhibit coolant-induced oil filter plugging to the significant quality achieved with CJ-4 compliant lubricant formulations containing the olefin copolymer dispersant VII described herein, when used in an oil to lubricate a cooled EGR engine.

The highly grafted, multi-functional olefin copolymer dispersant VIIs used in an oil to lubricate cooled EGR engines in accordance with embodiments of the present invention will generally be used in admixture with a lube oil basestock, comprising an oil of lubricating viscosity, including natural lubricating oils, synthetic lubricating oils and mixtures thereof. Natural oils include animal oils and vegetable oils (e.g., castor, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils used in this invention include one of any number of commonly used synthetic hydrocarbon oils, which include, but are not limited to, poly-alpha-olefins, alkylated aromatics, alkylene oxide polymers, interpolymers, copolymers and derivatives thereof where the terminal hydroxyl groups have been modified by esterification, etherification etc, esters of dicarboxylic acids and silicon-based oils. The oil of lubricating viscosity may comprise base oil selected from the group consisting of Group I base oil(s), Group II base oil(s), Group III base oil(s), Group IV base oil(s), Group V base oil(s) or a combination thereof.

The highly grafted, multi-functional olefin copolymers used in the oils to lubricate the cooled EGR engines of the present invention may be post-treated so as to impart additional properties necessary or desired for a specific lubricant application. Post-treatment techniques are well known in the art and include boronation, phosphorylation, and maleination, to the extent these optional post-treatments do not take the finished fluid containing the functionalized olefin copolymer out of compliance with CJ-4 or CI-4 PLUS specification, as applicable.

In another embodiment herein, an EGR engine is lubricated with lubricating oil further comprising at least one optional additive selected from the group consisting of zinc dialkyl dithiophosphates, friction modifiers, antioxidants, defoamants, surfactants, corrosion inhibitors, extreme pressure agents, detergents, and pour point depressants, to the extent these optional additives are not used in amounts taking the finished fluid out of compliance with CJ-4 or CI-4 PLUS specification, as applicable.

In another embodiment, an EGR engine is lubricated with an oil comprising a highly grafted, multi-functional olefin copolymer viscosity modifier, also called a viscosity index improver, comprising the reaction product of an acylated olefin copolymer and a polyamine, wherein the acylated olefin copolymer comprises an olefin copolymer having grafted thereon from 0.15 to 1.0 carboxylic groups per 1000 number average molecular weight units of olefin copolymer and wherein the olefin copolymer has a number average molecular weight of between 10,000 and 150,000.

The oils containing the olefin copolymer dispersant VII (OCPD VII) as taught herein also have the following advantages when used in cooled EGR engines: excellent for building film strength and reducing wear; low active treat rate of, for example, 0.1 to 2% wt. for 15W-40 oil; strong sludge suppression performance; provides superior performance in EGR engines; good shear stability, permanent and HTHS;

excellent dispersancy for soot handling and improved wear protection; allows for lower additive treat rate; and excellent used-oil low temperature viscosity properties, relative to the low temperature viscosity properties of oils not containing the olefin copolymer dispersant VII as taught herein.

A particularly useful olefin copolymer dispersant VII for addition to a lubricating oil composition in a cooled EGR engine is HiTEC® 5777 VM, an amine-functionalized ethylene-propylene copolymer DOCP, available from Afton Chemical Corporation, Richmond, Va.

The examples that follow are intended to further illustrate, and not limit, embodiments in accordance with the invention. All percentages, ratios, parts, and amounts used and described herein are by weight unless indicated otherwise.

EXAMPLES

Example 1

A finished fluid heavy-duty diesel engine oil (HDEO) lubricant representing an embodiment of the present invention was prepared, which is identified herein as Formulation 1, which was a low SAP DI formulated to contain an olefin copolymer dispersant VII (OCPD VII) prepared as follows. An acylated ethylene-propylene copolymer was prepared by free radically grafting maleic anhydride, in the presence of a solvent, onto an ethylene-propylene copolymer backbone. The acylated ethylene-propylene copolymer had a number average molecular weight of approximately 40,000 as determined by gel permeation chromatography. The reaction conditions and molar proportions of maleic anhydride and ethylene-propylene copolymer were such that about 7.2 molecules of maleic anhydride were grafted onto the olefin copolymer backbone. This is equivalent to 0.36 carboxylic groups per 1000 Mn of polymer backbone (i.e., 2×7.2=14.4 carboxylic groups/40,000 Mn=0.36 carboxylic groups/1000 Mn) to form the acylated ethylene-propylene copolymer. The acylated ethylene-propylene copolymer was reacted with N-phenyl-1,4-phenylenediamine (NPPDA), in the presence of a surfactant, at 160° C. for approximately six hours. The NPPDA was added in an amount sufficient to theoretically react with all of the grafted carboxylic groups.

Formulation 1 was a lubricating oil that was CJ-4 compliant and CI-4 PLUS compliant, which contained 7.5% OCPD VII, 76.6 wt % base oil, 0.2% pour point depressant additive, 15.7 wt % detergent inhibitor package containing dispersants, detergents, antiwear agents, antioxidants, friction modifiers, anti-foam agent. Comparison Formulation 2 is similar to Formulation 1 except that the OCPD VII ingredient was substituted with an unfunctionalized, non-dispersant olefin copolymer (NDOCP).

To mimic a coolant contamination scenario, the lubricant formulations of each of Formulation 1 and Comparison Formulation 2 were doped with 2 wt % Cummins branded engine coolant, and the resulting coolant-doped fluids are referenced herein as Formulation C1 and Formulation C2, respectively. Filter testing using Cummins M11 HST media were performed using each of the inventive, control and comparison lubricant formulations. This filtration test method was based on ISO 13357-2 (Petroleum Products—Determination of the filterability of lubricating oils—Part 2: Procedure for dry oils), and used Cummins M11 HST filtration media. The results for this used test method generally are predictive of the trend of results for the Cummins ISM EGR media test method, although the protocols and equipment are not identical. A test run was repeated on a separate sample of each of Formulation 1 and Comparison Formulation 2, and the two test runs are referenced herein as Formulation 1 and 1*, and Comparison Formulation 2 and 2*, respectively. Table 1 below shows the resulting silting (filtration) index data.

TABLE 1

| Test Lubricant | 100 mL Filtration Time (s) | 100 mL Filtration Time (s) | Filtration Index |
|---|---|---|---|
| 1 | 51.38 | 129.7 | 1.26 |
| 1* | 50.58 | 126.67 | 1.25 |
| C1 | 52.02 | 149.32 | 1.43 |
| 2 | 32.99 | 72.35 | 1.09 |
| 2* | 32.15 | 71.7 | 1.11 |
| C2 | 105.62 | 1697.88 | 8.04 |

As seen in the results reported in Table 1, the filtration index remained essentially unchanged for the Formulation C1, i.e., the coolant-doped form of lubricant Formulation 1 containing OCPD VII, whereas Formulation C2, i.e., the comparison coolant-doped lubricant of Comparison Formulation 2 containing NDOCP instead of OCPD VII, filtered significantly more slowly by comparison, i.e., the filtration time was more than doubled.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims. This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

What is claimed is:

1. A low SAP lubricating oil composition contaminated with engine coolant where the oil composition is adapted for inhibiting coolant-induced filter plugging, the composition comprising (1) a major amount of oil of lubricating viscosity; (2) at least about 0.1 percent of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging, as measured by the Cummins ISM EGR Test; and (3) about 2 percent engine coolant contamination in the lubricating oil composition composed of an approximately 50:50 mixture of water and pure (poly)ethylene glycol (total), wherein the amine functionalized olefin copolymer dispersant viscosity index improver inhibits coolant-induced filter plugging relative to a modified form of the lubricating oil composition which instead contains a non-amine functionalized, non-acylated form of the olefin copolymer dispersant but otherwise is the same; and wherein the lubricating oil composition contains 1.0 percent or less sulfated ash, 0.12 percent or less phosphorus, and 0.4 percent or less sulfur.

2. The lubricating oil composition of claim 1 containing the olefin copolymer dispersant viscosity index improver as active material in an amount of about 0.1 percent to about 20.0 percent.

3. The lubricating oil composition of claim 1, wherein the acylated olefin copolymer comprises copolymers or terpolymers of ethylene and $C_3$ to $C_{23}$ alpha-olefin and optionally a non-conjugated diene or triene on which has been grafted ethylenically unsaturated carboxylic reactants to a level of 0.3 to 0.75 carboxylic groups per 1000 number average molecular weight units (Mn).

4. The lubricating oil composition of claim 3, wherein the polyamine compound is selected from the group consisting of (a) an N-arylphenylenediamine represented by the formula:

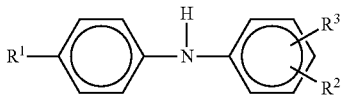

in which $R^1$ is hydrogen, —NH-aryl, —NH-arylalkyl, —NH-alkyl, or a branched or straight chain radical having from 4 to 24 carbon atoms that can be alkyl, alkenyl, alkoxyl, aralkyl, alkaryl, hydroxyalkyl or aminoalkyl; $R^2$ is —$NH_2$, $CH_2$—$(CH_2)_n$—$NH_2$, $CH_2$-aryl-$NH_2$, in which n has a value from 1 to 10; and $R^3$ is hydrogen, alkyl, alkenyl, alkoxyl, aralkyl, alkaryl having from 4 to 24 carbon atoms;

(b) an aminothiazole from the group consisting of aminothiazole, aminobenzothiazole, aminobenzo-thiadiazole and aminoalkylthiazole;

(c) an aminocarbazole represented by the formula:

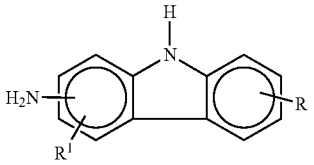

in which R and $R_1$ represent hydrogen or an alkyl, alkenyl or alkoxyl radical having from 1 to 14 carbon atoms;

(d) an aminoindole represented by the formula:

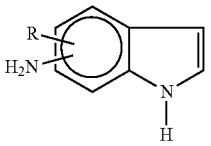

in which R represents hydrogen or an alkyl radical having from 1 to 14 carbon atoms;

(e) an aminopyrrole represented by the formula:

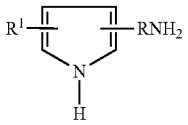

in which R is a divalent polyethylene radical having 2-6 carbon atoms and $R^1$ is hydrogen or an alkyl radical having from 1 to 14 carbon atoms;

(f) an amino-indazolinone represented by the formula:

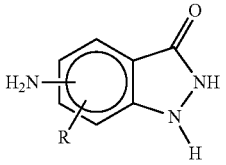

in which R is hydrogen or an alkyl radical having from 1 to 14 carbon atoms;

(g) an aminomercaptotriazole represented by the formula:

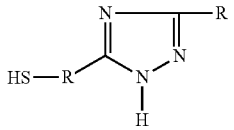

in which R can be absent or is a $C_1$-$C_{10}$ linear or branched hydrocarbon selected from the group consisting of alkyl, alkenyl, arylalkyl, or aryl;

(h) and an aminoperimidine represented by the formula,

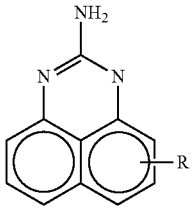

in which R represents hydrogen or an alkyl or alkoxy radical having from 1 to 14 carbon atoms;

(i) aminoalkyl imidazoles, such as 1-(2-aminoethyl) imidazole, 1-(3-aminopropyl) imidazole; and (j) aminoalkyl morpholines, such as 4-(3-aminopropyl) morpholine.

5. The lubricating oil composition of claim 1, wherein the major amount of oil comprises base oil selected from the group consisting of Group I base oil(s), Group II base oil(s), Group III base oil(s), Group IV base oils(s), Group V base oil(s) or a combination thereof.

6. The lubricating oil composition of claim 1, wherein the lubricating oil composition is compliant with at least one API lubricant service category selected from the group consisting of CJ-4, CI-4 PLUS, and CI-4.

7. A low SAP lubricating oil composition contaminated with engine coolant where the oil composition is adapted for inhibiting coolant-induced filter plugging, the composition comprising (1) a major amount of oil of lubricating viscosity; (2) at least about 0.1 percent of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging, as measured by a filtration test method based on ISO 13357-2 (Petroleum Products-Determination of the filterability of lubricating oils-Part 2: procedure for dry oils) using Cummins M11 HST filtration media; and (3) about 2 wt. percent engine coolant contamination in the lubricating oil composition composed of an approximately 50:50 mixture of water and pure (poly)ethylene glycol (total), wherein the amine functionalized olefin copolymer dispersant viscosity index improver inhibits coolant-induced filter plugging relative to a modified form of the lubricating oil composition which instead contains a non-amine functionalized, non-acylated form of the olefin copolymer dispersant but otherwise is the same; and wherein the lubricating oil composition contains 1.0 percent or less sulfated ash, 0.12 percent or less phosphorus, and 0.4 percent or less sulfur.

8. The lubricating oil composition of claim 7, wherein the Filtration Index (silting index data) value of the lubricating composition increases by no more than about 33% or less upon the lubricating oil composition being contaminated by about 2 wt. percent of said coolant, relative to the lubricating oil composition free of said coolant.

9. The lubricating oil composition of claim 7, wherein the Filtration Index (silting index data) value of the lubricating composition increases by no more than about 20% or less upon the lubricating oil composition being contaminated by about 2 wt. percent of said coolant, relative to the lubricating oil composition free of said coolant.

10. The lubricating oil composition of claim 7 is compliant with at least one API lubricant service category selected from the group consisting of API CJ-4 and API CI-4 PLUS.

11. The lubricating oil composition of claim 7 that is API CJ-4 compliant.

12. An oil concentrate in a low SAP lubricating oil composition contaminated with engine coolant where the oil composition is adapted for inhibiting coolant-induced filter plugging, the oil concentrate comprising a carrier or diluent oil and a minor amount of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging, as measured by the Cummins ISM EGR Test, in the low SAP lubricating oil composition containing (1) the oil concentrate in an amount effective to provide at least about 0.1 percent of the olefin copolymer dispersant viscosity index improver as active material; (2) a lubricating oil; and (3) about 2 wt. percent engine coolant contamination in the lubricating oil composition composed of an approximately 50:50 mixture of water and pure (poly)ethylene glycol (total), wherein the amine functionalized olefin copolymer dispersant viscosity index improver inhibits coolant-reduced filter plugging relative to a modified form of the lubricating oil composition which instead contains a non-amine functionalized, non-acylated form of the olefin copolymer dispersant but otherwise is the same; and wherein the lubricating oil composition contains 1.0 percent or less sulfated ash, 0.12 percent or less phosphorus, and 0.4 percent or less sulfur.

13. The oil concentrate of claim 12, wherein the lubricating oil composition is compliant with at least one API lubricant service category selected from the group consisting of CJ-4, CI-4 PLUS, and CI-4.

14. A lubricated engine lubricated with a low SAP lubricating composition contaminated with engine coolant where the oil composition is adapted for inhibiting coolant-induced filter plugging, the composition comprising an exhaust gas recirculation (EGR) system, whereby exhaust gases comprising soot generated in the combustion in the engine of fuel contact the low SAP lubricating oil composition, and wherein said lubricating oil composition comprises (1) a major amount of oil of lubricating viscosity; (2) at least about 0.1 percent of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging, as measured by the Cummins ISM EGR Test; and (3) about 2 wt. percent engine coolant contamination in the lubricating oil composition composed of an approximately 50:50 mixture of water and pure (poly)ethylene glycol (total), wherein the amine functionalized olefin copolymer dispersant viscosity index improver inhibits coolant-induced filter plugging relative to a modified form of the lubricating oil composition which instead contains a non-amine functionalized, non-acylated form of the olefin copolymer dispersant but otherwise is the same; and wherein the lubricating oil composition contains 1.0 percent or less sulfated ash, 0.12 percent or less phosphorus, and 0.4 percent or less sulfur.

15. The engine of claim 14, wherein the lubricating oil composition is compliant with at least one API lubricant service category selected from the group consisting of API CJ-4 and API CI-4 PLUS.

16. The engine of claim 14, wherein the EGR engine comprises a diesel engine.

17. The engine of claim 16, wherein said lubricated engine achieves a filter delta P value of less than about 150 kPa, as measured in the Cummins ISM Lubricant Test.

18. The engine of claim 17, wherein said lubricated engine achieves a filter delta P value of less than about 50 kPa, as measured in the Cummins ISM Lubricant Test.

19. A method of reducing coolant-induced filter plugging in an EGR engine, comprising adding to and operating in the crankcase of the engine contaminate with engine coolant, a lubricating oil composition adapted for inhibiting coolant-induced filter plugging that is low SAP and/or compliant with at least one API lubricant service category selected from the group consisting of CJ-4, CI-4 PLUS, CI-4, CF-4, CG-4, and CH-4, wherein said lubricating oil composition once in the engine comprises (1) a major amount of oil of lubricating viscosity; (2) at least about 0.1 percent of an amine-functionalized olefin copolymer dispersant viscosity index improver comprising the reaction product of an acylated olefin copolymer and a polyamine compound, wherein the olefin copolymer dispersant viscosity index improver is present in an amount effective to inhibit coolant-induced filter plugging, as measured by the Cummins ISM EGR Test; and (3) about 2 wt. percent engine coolant contamination in the lubricating oil composition composed of an approximately 50:50 mixture of water and pure (poly)ethylene glycol (total), wherein the amine functionalized olefin copolymer dispersant viscosity index improver inhibits coolant-induced filter plugging relative to a modified form of the lubricating oil composition which instead contains a non-amine functionalized, non-acylated form of the olefin copolymer dispersant but otherwise is the same; and wherein the lubricating oil composition contains 1.0 percent or less sulfated ash, 0.12 percent or less phosphorus, and 0.4 percent or less sulfur.

20. The method of claim 19, wherein the lubricating oil composition is API CJ-4 compliant.

* * * * *